US009214142B2

(12) United States Patent
May

(10) Patent No.: US 9,214,142 B2
(45) Date of Patent: Dec. 15, 2015

(54) FREE FLOATING INTEGRATED LUG BRIDGE

(71) Applicant: Randall Lee May, Newport Beach, CA (US)

(72) Inventor: Randall Lee May, Newport Beach, CA (US)

( * ) Notice: Subject to any disclaimer, the term of this patent is extended or adjusted under 35 U.S.C. 154(b) by 284 days.

(21) Appl. No.: 13/787,504

(22) Filed: Mar. 6, 2013

(65) Prior Publication Data

US 2013/0233148 A1 Sep. 12, 2013

Related U.S. Application Data

(60) Provisional application No. 61/607,264, filed on Mar. 6, 2012, provisional application No. 61/719,853, filed on Oct. 29, 2012.

(51) Int. Cl.
*G10G 5/00* (2006.01)

(52) U.S. Cl.
CPC ..... *G10G 5/005* (2013.01)

(58) Field of Classification Search
CPC ..... G10D 13/02; G10D 13/026; G10D 13/00; G10D 13/028; G01G 5/00; G01G 5/005; G01G 7/00; G01G 7/005; G01G 1/00
USPC ..... 84/411 R, 421
See application file for complete search history.

(56) References Cited

U.S. PATENT DOCUMENTS 45,104 A 11/1864 Weston
909,217 A 1/1909 Presba et al.
1,179,063 A 4/1916 Aldret
1,191,426 A 7/1916 Huddle
1,296,619 A 3/1919 Bulat
2,524,518 A 10/1950 D'Arcy
2,547,818 A 4/1951 Gould
2,717,109 A 9/1955 Walsh
2,990,745 A 7/1961 Casavant
3,227,414 A 1/1966 Dean
4,225,107 A 9/1980 Gleason
4,256,007 A 3/1981 Streit
4,387,839 A 6/1983 Dranchak
4,402,441 A 9/1983 Jines et al.
4,448,105 A 5/1984 Cordes
4,453,442 A 6/1984 LaFlame
4,453,446 A 6/1984 Hoshino
4,605,144 A 8/1986 LaFlame
4,634,032 A 1/1987 LaFlame
4,796,508 A 1/1989 Hoshino
4,799,610 A 1/1989 Hesieh
5,400,683 A 3/1995 LaFlame
5,464,137 A 11/1995 Shirdavani (Continued)

*Primary Examiner* — Kimberly Lockett
(74) *Attorney, Agent, or Firm* — Kirk A. Buhler; Buhler & Associates

(57) ABSTRACT

A percussion instrument holder that allows attachment to a user mounted carrier. The holder allows adjustment for positioning about the user, and pivoting of the holder to allow the holder to pivot or rotate up to allow the holder with instruments to fit a narrower space. The holder further allows for pivotal attachment of individual drums to link or pivot allowing the linked drums to articulate. The holder can also consist of members that allow a connected drum to move in horizontal position, angle, or height of the drum. A plurality of unique drum connecting members is disclosed that allow the connecting members to connect onto drum tension rods or on a drum lug. The plurality of connecting members can be fabricated from multiple pieces that can interconnectably be locked into position.

20 Claims, 21 Drawing Sheets

(56) References Cited

U.S. PATENT DOCUMENTS

| | | | | |
|---|---|---|---|---|
| 5,520,292 | A | 5/1996 | Lombardi | |
| 5,524,462 | A | 6/1996 | Loughlin | |
| 5,573,158 | A | 11/1996 | Penn | |
| 5,691,492 | A | 11/1997 | May | |
| D388,246 | S | 12/1997 | Patterson | |
| 5,806,734 | A | 9/1998 | Scott | |
| 5,973,247 | A | 10/1999 | Matthews | |
| 6,028,257 | A | 2/2000 | May | |
| 6,172,290 | B1 | 1/2001 | May | |
| 6,403,869 | B2 | 6/2002 | May | |
| 6,770,805 | B2 | 8/2004 | May | |
| 7,326,842 | B2 | 2/2008 | May | |
| 7,420,110 | B2 | 9/2008 | May | |
| 7,673,776 | B2 | 3/2010 | May | |
| RE42,487 | E | 6/2011 | May | |
| 8,053,655 | B2 | 11/2011 | May | |
| 2006/0081114 | A1* | 4/2006 | Shimada | 84/421 |
| 2012/0048096 | A1 | 3/2012 | May | |
| 2014/0060285 | A1* | 3/2014 | Bradfield et al. | 84/411 R |

* cited by examiner

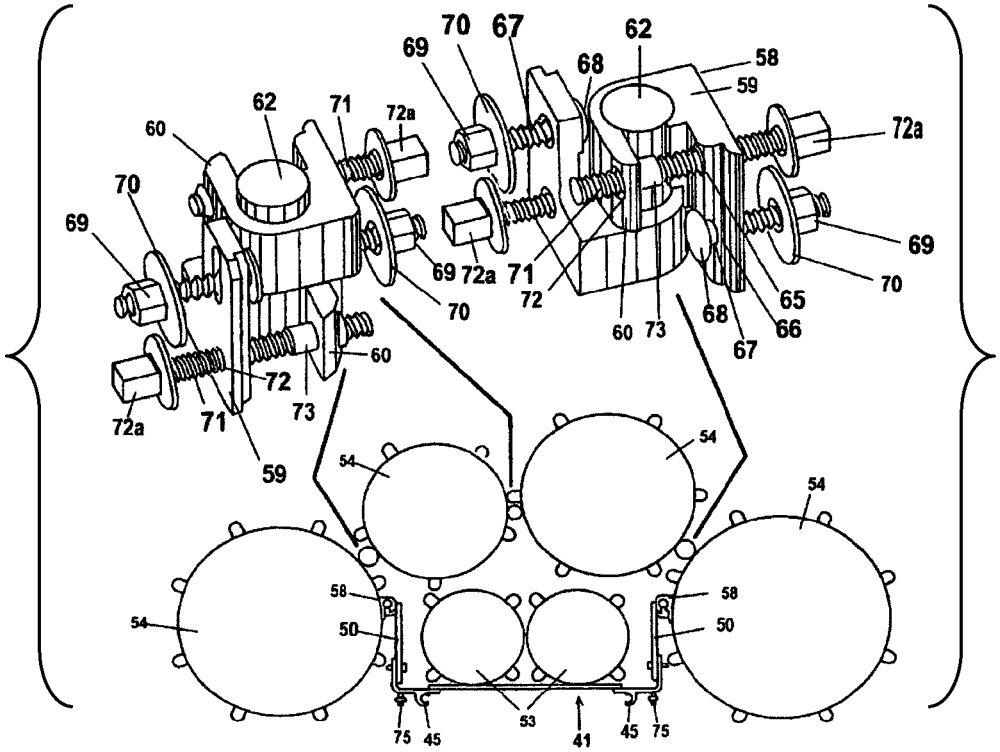
FIG. 9
FIG. 10
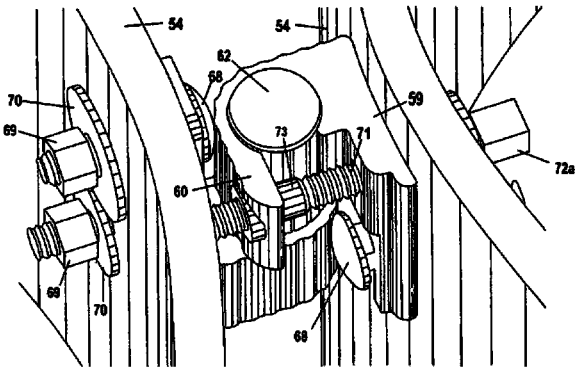

FREE FLOATING INTEGRATED LUG BRIDGE

CROSS REFERENCE TO RELATED APPLICATION

This application claims the benefit of provisional application 61/719,853 filed Oct. 29, 2012 and claims the benefit of provisional application 61/607,264 filed on Mar. 6, 2012.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to new and useful improvements in apparatus for supporting or carrying percussion instruments, particularly drums of various kinds.

2. Description of Related Art including information disclosed under 37 CFR 1.97 and 1.98

The prior art discloses many examples of apparatus for supporting percussion instruments but none providing the combination of features disclosed and claimed herein.

May U.S. Pat. No. 5,691,492 discloses hardware for supporting drums that is of a hinged construction and has one part of the hinge connectable to an external support, e.g., J-rods on a fixed support or a marching drum carrier, and another part of the hinge connectable to the shell of a drum or to the tension rods on a drum or to other hardware on the drum.

May U.S. Pat. No. 6,028,257 shows drum hardware and drums secured thereon preferably supported on a vest type carrier or a T-bar carrier or a fixed post or pedestal.

May U.S. Pat. No. 6,172,290 shows a hinged support for an array of drums.

May U.S. patent application Ser. No. 09/756,479, filed Jan. 8, 2001, allowed Jan. 28, 2002, shows a hinged support for one or more drums having means for adjusting the position of a drum to a fixed support or drum carrier. The hinged support may be for an array of drums having means for adjusting the position of the drum array pivotally and inwardly and outwardly relative to fixed drums.

Other possibly relevant prior art is Pyle U.S. Pat. No. 5,054,357; May U.S. Pat. No. 5,072,910 and May U.S. Pat. No. 5,300,810.

Various prior inventions have been disclosed that attempt to provide percussion positioning and locating apparatus, but none of the listed inventions provide the combination of features and functions proposed by the disclosed carrier.

BRIEF SUMMARY OF THE INVENTION

A percussion instrument holder that allows attachment to a user mounted carrier. The holder allows adjustment for positioning about the user, and pivoting of the holder that allows the holder to slide, pivot or rotate to allow the holder with instruments to fit a narrower space. The holder further allows for pivotal attachment of individual drums to link and pivot to allow the linked drums to articulate. The drums can be fully adjusted in relation to one another, similar to moving links in a chain. The holder can also consist of members that allow a connected drum to move in horizontal position, angle, or height of the drum.

One of the objects of this invention is to provide a new and improved hinged support for an array of drums for support on a pedestal or marching type carrier. The hinge allows all the instruments connected to the rail to hinge as a group.

Another object of the invention is to provide a new and improved hinged support for an array of drums for support on a pedestal or marching type carrier having means for adjusting the position of a drum array relative to fixed drums thereon.

Another object of the invention is to provide a new and improved hinged support for an array of drums for support on a pedestal or marching type carrier having means for adjusting the position of a drum array pivotally and inwardly and outwardly relative to fixed drums thereon. Another object of the invention is to provide a new and improved hinged support for an array of drums for support on a pedestal or marching type carrier having means for adjusting the position of the drums in a drum array relative to each other. The adjustment on the tenor rail or back bar can be narrowed or widened, offset left or right to balance weight. The adjustments can allow the drums to move or slide closer or further away from the body for playing comfort.

Another object of the invention is to provide a new and improved hinged support for an array of drums for support on a pedestal or marching type carrier having novel means for supporting the drums thereon.

Another object of the invention is to provide a new and improved hinged support for drums for support on a pedestal or marching type carrier by J-rod supports.

Another object of the invention is to provide a new and improved means for connecting a hinged support for an array of drums for support on individual drums.

Another object of the invention is to provide a new and improved means for connecting a hinged support for an array of drums for support on individual drums, and having hinged sliders for the supporting J-rods of the hardware.

Another object of the invention is to provide new and improved supporting hardware supporting an array of drums, as in a marching drum assembly, having a tubular structure supporting a plurality of drums for pivotal and inward and outward adjustment of the drums.

Another object of the invention is to provide a new and improved hinged support having a back bar or tenor rail for supporting an array of drums for support on a pedestal or marching type carrier in which drums are adjustably supported on rails of a back bar assembly and having J-rod supports adjustable supported thereon.

Another object of the invention is to provide a new and improved hinged support having a back bar assembly for supporting an array of drums for support on a pedestal or marching type carrier in which the back bar assembly is adjustable in length for adjusting the location of drums thereon.

Another object of the invention is to provide a new and improved hinged support for an array of drums for support on a pedestal or marching type carrier having means for pivotally adjusting the position of one drum in the array relative to another.

Another object of the invention is to provide new and improved supporting hardware supporting an array of drums, and having a tubular swivel support for the drums fitting existing lugholes in the drums.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

FIG. 9 is a plan view of the hinge assemblies of FIGS. 3-6 with detail isometric views, in exploded relation thereto, showing the hardware supporting the two outer large drums on the hinge.

FIG. 10 is a fragmentary isometric view of the hardware supporting the two outer large drums on the hinge.

DETAILED DESCRIPTION OF THE INVENTION

Supporting Hardware of this Invention

Figure 1:
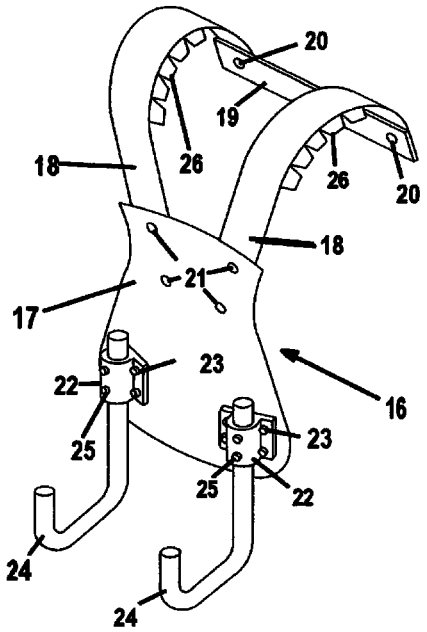
FIG. 1 is an isometric view of a supporting vest and J-bars for supporting marching drum assemblies as described below.
Figure 2:
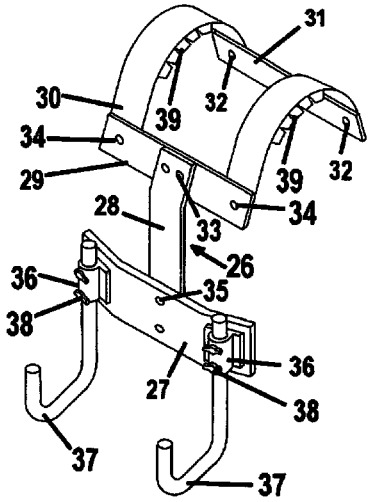
FIG. 2 is an isometric view of a novel T-bar assembly and J-rods for supporting drums containing features of the supporting vest of FIG. 1 for marching drums as described below.

FIGS. 1 and 2 illustrate prior art devices for supporting the drum hardware shown in FIGS. 3-22. FIGS. 1 and 2 show vest and T-bar constructed instrument carrier, but tubular and other forms of vest construction can be used to support the drum hardware used for carrying drums in marching bands.

Referring to FIG. 1, there is shown a vest- or harness-type 16 carrier for percussion instruments that comprise a vest portion 17, shoulder straps 18 and back bar 19. Back bar 19 is removably secured to shoulder straps 18 by screws or bolts 20. Where desired, back bar 19 may be fixed as by welding or the like. Vest portion 17 is removably secured to shoulder straps 18 by screws or bolts 21 and has a pair of J-bar receptacles 22 secured by screws or bolts 23. J-bars 24 are supported in receptacles 22 and secured in position by T-bolts or set screws 25. J-bar receptacles may also be used of the type shown in FIGS. 38-41 and 51-55 of May U.S. Pat. No. 6,028,257. The J-bar receptacles are show because they are the current method used to connect the drum hardware to the carrier. Other methods of attachment are contemplated that perform similar function, such as mounting the drum hardware directly to sliders on the carrier, or "U" or "O" shaped receptacles. In the preferred embodiment, the receiver(s) are made from hollow J-rod clamping receptacles. Shoulder straps 18 have pads 26 to cushion the load of the instruments carried by carrier 16. This carrier 16 is constructed and used as in May U.S. Pat. No. 5,691,492.

Referring to FIG. 2, there is shown a T-bar-type carrier 26 for percussion instruments, which comprises a belly plate 27, vertical bar 28, upper horizontal bar 29, shoulder straps 30 and back bar 31. Back bar 31 is removably secured to shoulder straps 30 by screws or bolts 32. Where desired, back bar 31 may be fixed as by welding or the like. Upper horizontal bar 29 is removably secured to shoulder straps 30 by screws or bolts 34. Upper horizontal bar 29 is removably secured to the upper end of vertical bar 28 by screws or bolts 33.

Belly plate 27 is removably secured to the lower end of vertical bar 28 by screws or bolts 35. A pair of J-bar receptacles 36 is secured on belly plate 27 by screws or bolts or the like. J-bar receptacles may also be used of the type shown in FIGS. 38-41 and 51-55 of May U.S. Pat. No. 6,028,257. J-bars 37 are supported in receptacles 36 and secured in position by T-bolts 38. Shoulder straps 30 have pads 39 to cushion the load of the instruments carried by T-bar carrier 26. This carrier 26 is constructed and used as in May U.S. Pat. No. 5,691,492.

An Embodiment for Supporting Drum Arrays

FIGS. 3-6 show a back bar or hinge assembly 41 to provide support for a multiple drum assembly or array 40 (FIGS. 3 and 4) as used in marching bands. The back member or hinge assembly is also called a tenor rail or tenor back member because one or more tenor drums can be attached to the rail. Hinge assembly 39 is similar in function to that shown in FIGS. 13-17 of May U.S. Pat. No. 6,028,257 with additional features permitting adjustability that is not possible in the embodiment of the patent.

Multiple drum assembly or array 40 (FIG. 3) comprises typically 2-6 drums secured together for support and carrying by a drummer as in a marching band. Drum array 40 includes one or more snare drums 53 supported on the fixed part of a hinge assembly and a plurality of large drums 54 supported on the hinge parts of a hinge assembly. The individual drums 54 of drum array 40 are preferably larger drums ranging about 8"-14" in diameter. Drum 53 on back bar assembly 41 is preferably a smaller drum about 6" in diameter. The array of drums can be all the same size and tone of drums, all different size and tone, or a combination thereof.

In this embodiment, hinge assembly 39 provides a hinged support between the drum array 40 and a suitable marching carrier 16 or 26 as shown in FIGS. 1 and 2. Hinge assembly 39 (FIGS. 5 and 6) comprises a back bar or bars 41 that is/are fixed member of the hinge. Back bar(s) 41 have/has two end parts or pieces 42 each of which comprises a one-piece casting having a flat portion 43 with a bent portion at a right angle thereto.

Figure 5:
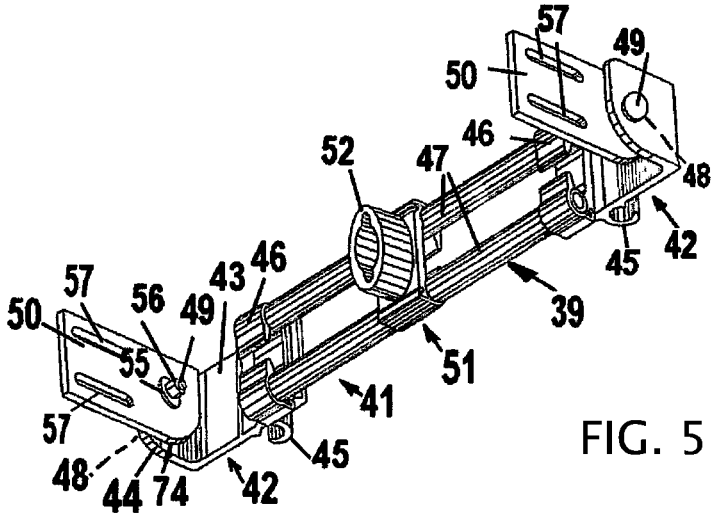
FIG. 5 is an isometric view of the hinge assembly shown in FIG. 3 and FIG. 4 with a single mounting support for snare drums.

Flat portion 43 has a J-rod receptacles or receivers 45 formed integral therewith on the underside as viewed in FIG. 5. J-rods 24 in FIG. 1 or 37 in FIG. 2 are supported in receptacles 45 and secured in position by compression fit. Two receptacles 46 are formed integral with the upper surface of flat portion 43. Back bar assembly have two cylindrical rods 47, which fit, into receptacles 45 to secure the assembly together. In this embodiment, the two cylindrical rods support the structure for the J-rod receptacles, but numerous other back bar members is contemplated that perform equivalent function. Other types of back members may include but are not limited to one or more tubes or rods of various shapes including round, square, rectangular, elliptical, octagonal and others. The back member may be a single plate or extrusion that performs the function of connecting the carrier to a drum or a drum array. The adjustment to the back member may include width adjustment that allows the back member to widen, or narrow to accommodate instruments or users. The receiver(s) on the back member allow lateral adjustment of the receptacles or receivers. The lateral adjustment allows the receivers to slide on the back member. The receiver(s) can be positioned in finite or infinite locations. The receiver locations can be located symmetrically, non-symmetrically, offset right, left, widened or narrowed on the back member. As the receiver(s) are moved on the back member the array of drums may move closer or farther away from the carrier.

Re-bent end portions have holes 48 (FIGS. 5 and 6) providing a tilt or pivot for the hinge. Holes 48 in each bent end portion of back bar flat portion 43 have bolts 49 inserted there through to secure hinge plates 50 which support the drum array 40 for pivotal movement. The pivotal or tilt allows the drums attached to the back bar to be rotated about the axis of the hinge or the carrier. This allows the array to occupy a smaller space and allows the user and the array to fit through a doorway or between objects that may not be able to pass through if the drums would not pivot or tilt. The array of drums may also tilt to a fixed angle to allow easier playing of the drums. The angle may be finite or infinite increments. The pivoting may be locked in orientation or free to move without loosening a clamp or locking mechanism. A supporting member 51 is slidably supported on rods 47 to support the snare drums 53 (FIG. 3).

Figure 3:
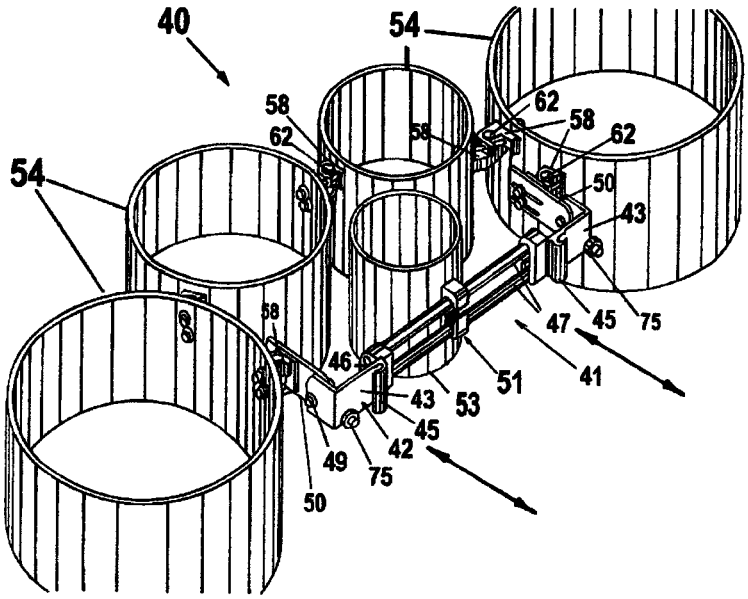
FIG. 3 is an isometric view of the embodiment of supporting hardware illustrating inward and outward adjustment of the drums.

FIG. 3 shows details of the connection of a single snare drum 53 (FIG. 3) or two snare drums 53 (FIG. 7) to back bar assembly 41. In this embodiment, a hollow standoff or spacer boss spaces 52, shown in FIG. 5, and supports drum 53 from sliding member 51 on back bar assembly 41. The hardware that attaches to the drum uses existing holes in the drum that secures the drum casing on the drum. Bolts extend through washers, holes in the drum wall, spacer boss, holes in hinge back bar assembly 41, washers, and are secured by nuts.

Figure 6:
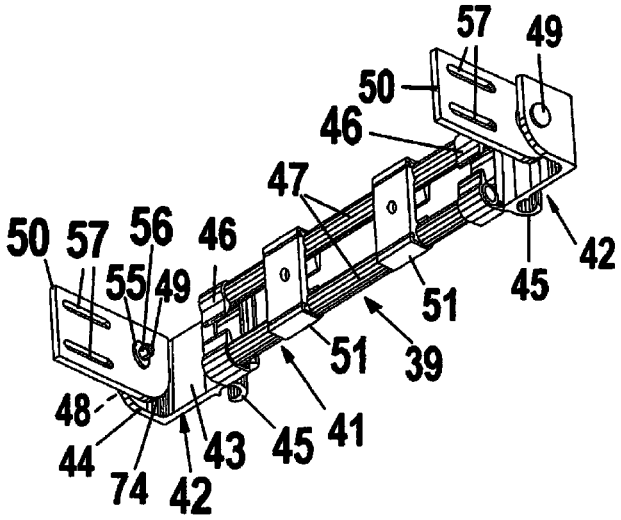
FIG. 6 is an isometric view of the hinge assembly shown in FIG. 3 and FIG. 4 with a double mounting support for a pair of snare drums.

While this connection is shown for a single drum 53 in FIG. 5, it could also be used in assembling two drums 53. In FIG. 6 there are shown details for the connection of two drums 53 to hinge back bar assembly 41.

Figure 4:
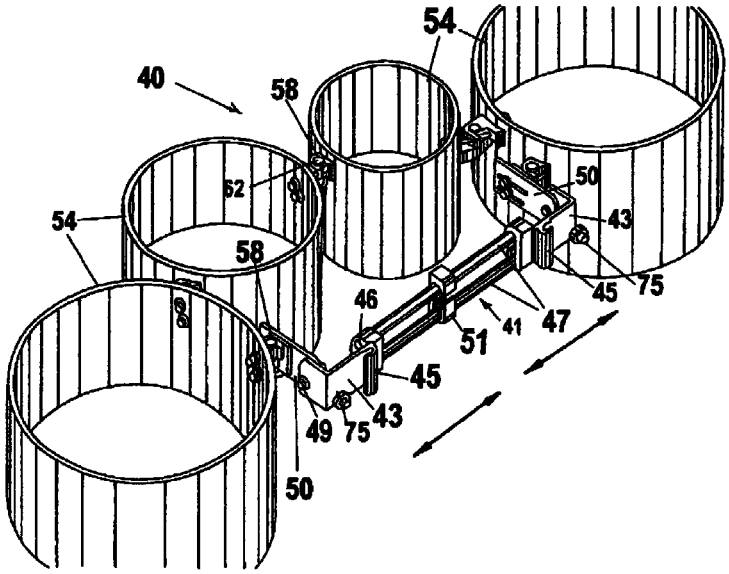
FIG. 4 is an isometric view of the embodiment of supporting illustrating lateral adjustment of the drums.

Each hinge plate 50 has a hole 48, shown in FIGS. 5 and 6, which receives bolt 49 extending through and washer 55 and secured in place by nut 56. Each hinge plate 50 has a pair of slots 57 through which bolts 56 extend to secure a clamping receptacle 58 thereon (FIGS. 3 and 4). The receivers can move on the tenor back member to allow positoning of the drum or drum array relative to the user. The positioning allows the J-rod receivers to be moved on the tenor back member. The receivers can be laterally move together, apart, symetrical or non-symetrically on the tenor back member. This allows the drum array to be moved closer to the user, farther away from the user, justified left or right of the user, or centered in relationship to the user.

A minimum of one receiver is needed to retain the drum postioning system on the carrier, but in the prefered embodiment two receivers are used. In another embodiment three or more receivers are used to allow quick position changing of the drum array by simply lifting the array off one set of receivers, and placing the drum array onto a second set of receivers.

Assembly of Drum Array on Hinge

The assembly of hinge assembly 41 and the array of drums 40 together is best followed and understood by starting with the bare hinge assemblies and placing the components thereon step by step.

FIGS. 7-10 show details of the connection of the individual drums into an array using pairs of receptacles 58. The clamping receptacle 58 is of a type available commercially and is described more completely in FIGS. 39-41, 47-49, and 52-55 of May U.S. Pat. No. 6,028,257. Clamping receptacles 58 are cast or extruded and have a base portion 59 for mounting and an open edge portion 60 which can flex to clamp rods or posts adjustably.

Receptacles 58 may have a cylindrical inner surface 61 or a polygonal inner surface 61 to clamp on a supporting or connecting rod or post 62. Bolts 63 extend through open edge portion 60 and base 59 of receptacles 58 and slots 57 to be held in place by nuts 64. Tightening of nuts 64 secures receptacle 58 tightly on rods or posts 62. Receptacles 58 are arranged on the large drums 54 to each other as an array 40 of drums, with the receptacles on outermost drums 64 supporting the array on hinge plates 50.

Figure 7:
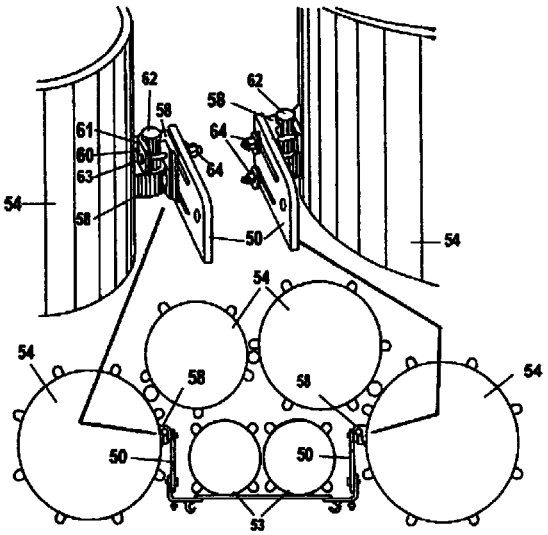
FIG. 7 is a plan view of the hinge assemblies of FIGS. 3-6 with detail isometric views, in exploded relation thereto, showing the hardware supporting the two outer large drums on the hinge.
Figure 8:
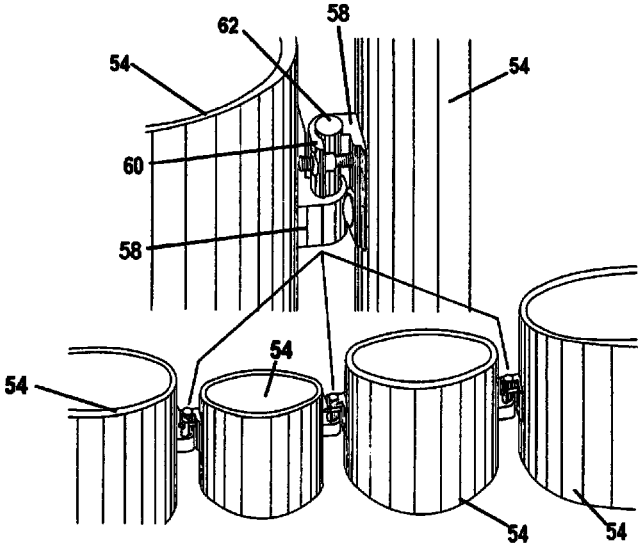
FIG. 8 is a plan view of the hinge assemblies of FIGS. 3-6 with detail isometric views, in exploded relation thereto, showing the hardware supporting the outer large drums to each other.

FIGS. 7-9 show four of the larger drums 54 secured by receptacles 58. On adjacent drums 54, receptacle 58 has a base 59 twice the width of open edge portion 60. Holes 65 and 66 (FIG. 9) in base 59 are aligned with similarly spaced holes in the shell of drum 54. Bolt 67 has a head 68 positioned on the outside of base 58 and extends through the drum shell to be secured in place by nut 69 and washer 70.

Open edge portion 60 has a hole 72 aligned with hole 65 in base 59 and a hole in the drum shell. Bolt 71 has a head 72*a*, shaped for operation by a square drum key, positioned on the inside of the drum shell and extending through the drum shell hole base 58 and extends through hole 66 in base 59 and hole 72 in open edge portion 60. A threaded sleeve 73 fits hole 72 and received the threaded end of bolt 71.

As seen in FIGS. 7-9, receptacles 58 are mounted on adjacent drum shells and aligned to receive connecting rod 62. When bolt 71 is operated to tighten sleeve 73, open edge portions 60 are flexed to clamp connecting rod 62. Prior to clamping, the drums 54 may be adjusted longitudinally and angularly in relation to connecting rod 62.

When four of the drums 54 are connected together as shown in FIGS. 7-9, the array 40, which is produced, is ready for assembly on hinge assembly 41. FIG. 7 shows details of the connection of the drum array 40 to hinge plates 50. FIGS. 5 & 6 show hinge plates 50 supported for pivotal movement on end portions 44 or back bar assembly 41 bolts 49, nuts 56, and washers 55. While four drums are shown in some of the figures, as few as one drum or more than four drums can be located on the back member.

The outermost drums 54 of drum array 40 have receptacles 58 supported thereon (FIGS. 3, 4, 7, 8, 9), as described above for connection of adjacent drums together. Another receptacle 58 is supported on each hinge plate 50 in alignment with the receptacles mounted on the outermost drums 54. The aligned receptacles 58 receive connecting rod 62. When bolt 71 is tightened, open edge portions 60 are flexed to clamp connecting rod 62. The receptacles 58 are mounted on hinge plates 50 in slots 57, which permit the position of the drum array 40 to be adjusted longitudinally of the hinge plates. The drum array can be locked onto the hinge plate, or onto the tenor back member. The drums can be free or locked onto the back member. When two or more drums are connected together with the pivotal linkage, and the connections to the outer drums are moved, the arc formed by the drums changes. FIG. 7 shows the array of four drums as a tighter arc than the array of drums shown in FIG. 8. While FIGS. 7 and 8 show to extreme differences in the arc formed by the array of drums it should be obvious that a large number of variations in the shape of the arc are possible, and that moving the outside drums alters the shape of the arc.

Each hinge plate 50 is pivoted on bolts 49 to a selected position. Each hinge plate 50 has an end portion cut in curvature 74 (FIGS. 5 and 6) shown permitting the edge to clear back bar end portions 42. A set bolt 75 (FIGS. 3, 4 and 9) extends through a threaded hole in back bar end portions 42 to engage the end portion 74 of hinge bar 50 to secure the hinge in a selected position.

Another Embodiment for Supporting Drum Arrays

A hinge assembly 80 (FIGS. 11-16) is provided for supporting a multiple drum assembly or array 81 as used in marching bands. Hinge assembly 80 is similar in function to that shown in FIGS. 11-12 of May U.S. Pat. No. 6,028,257 with additional features permitting adjustability that is not possible in the embodiment of the patent.

Figure 11:
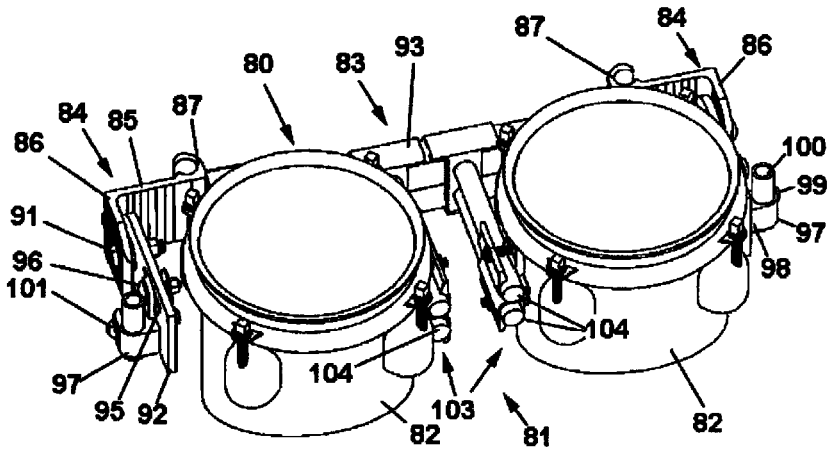
FIG. 11 is an isometric view of another embodiment of supporting hardware supporting an array of drums, as in a marching drum assembly, having a tubular structure supporting a plurality of drums for pivotal and inward and outward adjustment of the drums.
Figure 12:
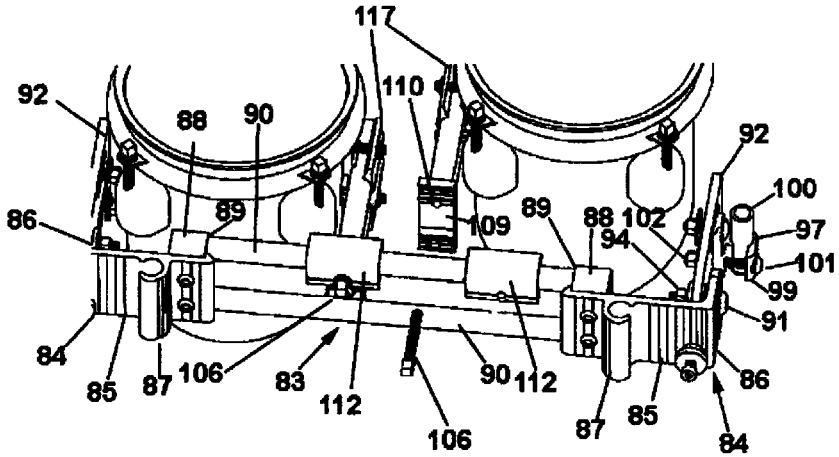
FIG. 12 is isometric view from the rear of the embodiment of supporting hardware shown in FIG. 11 showing details of the pivotal and inward and outward adjustment of the drums.

The drum assembly or array 81 (FIG. 11) comprises at least one drum 82 supported and carried by a drummer as in a marching band. FIGS. 11-12 show the embodiment using two drums, with each drum independently connected to the hinge assembly 80. Drum array 81 includes drums 82 supported on the fixed part of a hinge assembly. It is also contemplated that the drum array 81 can be mounted on the pivotal portion of the hinge assembly. In this embodiment, hinge assembly 80 provides a hinged support between the drum array 81 and a suitable marching carrier 16 or 26 as shown in FIGS. 1 and 2.

Hinge assembly 80 (FIGS. 11 and 12) comprises a back bar assembly 83 that is the fixed member of the hinge. Back bar assembly 83 has two end pieces 84 each of which comprises a one-piece casting having a flat portion 85 with a re-bent portion 86 bent at a right angle thereto.

Flat portion 85 has J-rod receptacles 87 formed integral therewith, in which J-rods are supported and secured in position by compression fit. A socket member 88 with two receptacles 89 is secured on each flat portion 85. Back bar assembly 83 have two cylindrical rods 90 that fit on opposite ends into receptacles 89. The embodiment shown uses two cylindrical rods for the back bar assembly 83, but the rods my be solid and not cylindrical. In another contemplated embodiment the back bar is fabricated from square tubes or rods. In still another contemplated embodiment the back bar assembly can be fabricated from a single rectangular tube or a plate that may also form the end pieces that have been previously shown connected to the cylindrical rods.

Re-bent end portions 86 have holes providing a pivot for the hinge. Holes in each re-bent end portion 86 of back bar flat portion 85 have bolts 91 inserted there through and washer 94 secured by nuts 102 to secure hinge plates 92 which support the drum array 81 for pivotal movement. A supporting member 93 is slidably supported on rods 90 to support the drums 82 (FIGS. 11 and 12). Each hinge plate 92 has a slot 95 through which bolts 96 extend to secure a clamping receptacle 97 thereon.

Receptacles 97 may have a cylindrical inner surface or a polygonal inner surface to clamp on a supporting or connecting rod or post 100. Bolts 101 extend through open edge portion 99 and base 98 of receptacles 97 and slots 95 to be held in place by nuts 102. Tightening of nuts 102 secures receptacle 97 tightly on rods or posts 100.

Drum supports 103 comprise a pair of rods 104 mounted on support plates 109 that are best viewed in FIGS. 13-16. Rods

104 each have one end secured against plate 109 by bolts 106 having square heads for operation by a drumhead key. A shoulder on rod 104 engages on plate 105 to secure rod 104 from rotation.

On the side of plate 109 opposite the rods 104 are roughened curved recesses 110, which fit against rods 90. The upper end of plate 109 has a groove 111, which receives the hooked edge of a spring clip 112. The upper bolt 106 (FIG. 12) passes through the thickened edge portion 114 of spring clip 112 into the end of upper rod 104. When this bolt 106 is tightened, spring clip 112 secures the assembly of rods 104 on the upper rod 90 for rotation thereon, with the lower curved recess 110 resting against the lower rod 90 in the initial position of the assembly at rest.

The rods 104 are cantilevered on rods 90 and support drums 82 at their outer ends. Supporting plate 117 is secured on drum 82 by bolts 106 which extend through supporting plates 117. Bolts 106 and supporting plate 117 on rods 104 can be loosened to allow for sliding movement thereon. FIGS. 13-16 show two tubes connection the drum to the tenor back member, but the connection to the back member can be made from a variety of materials and in a variety of shapes. In any embodiment, at least one member connects to the back member and extends away from the back member. One or more drums connect to the extending member. The attachment of the drum or drums to the extending member allows the drum or drums to be positioned up, down, or angled forward, backward or any combination of orientations. Each drum independently can be oriented to suit the user.

Operation

Hinge assembly 80 is supported by positioning J-rod receptacles 87 over J-rods 135 on a marching vest, and sliding the hinge assembly onto the J-rods. Drums 82 are supported on rods 104 and are movable thereon. Rods 104 are clamped on rods 90 for sidewise adjustment of the spacing of drums 82 and for pivotal adjustment.

Figure 13:
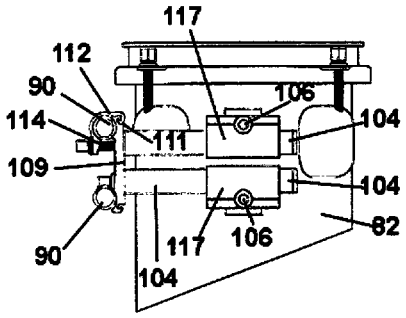
FIG. 13 is a view in side elevation of the embodiment of FIG. 11 with a drum supported in place and illustrating inward and outward adjustment of the drums.
Figure 14:
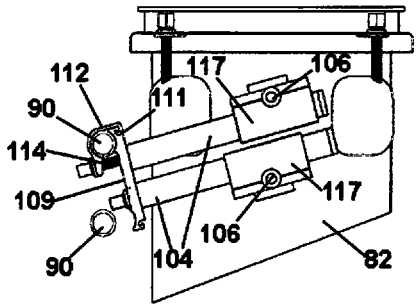
FIG. 14 is a view in side elevation of the embodiment of FIG. 11 with a drum supported in place and illustrating upward and downward adjustment of the drums.

FIGS. 13 and 14 illustrate the operation of this hinge assembly to raise and lower drum 82 while keeping the drumhead level. Supporting plate 109 is pivoted outward to raise drum 82 while clamping plates 117 on the upper and lower rods 104 are adjusted to level the drumhead.

Figure 15:
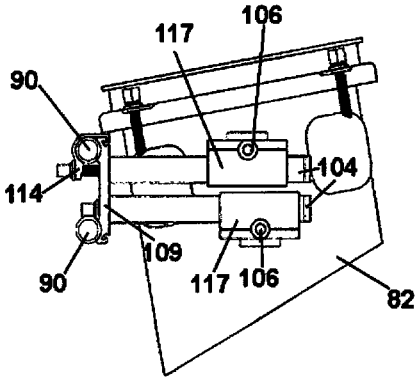
FIG. 15 is a view in side elevation of the embodiment of FIG. 11 with a drum supported in place and illustrating front to back pivotal adjustment of the drums.
Figure 16:
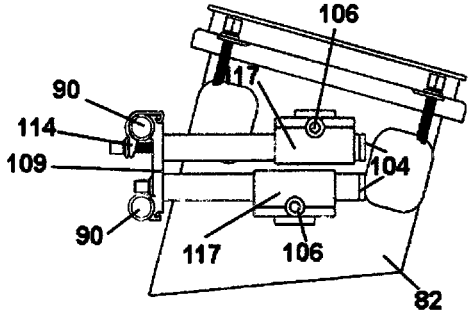
FIG. 16 is a view in side elevation of the embodiment of FIG. 11 with a drum supported in place and illustrating back to front pivotal adjustment of the drums.
Figure 17:
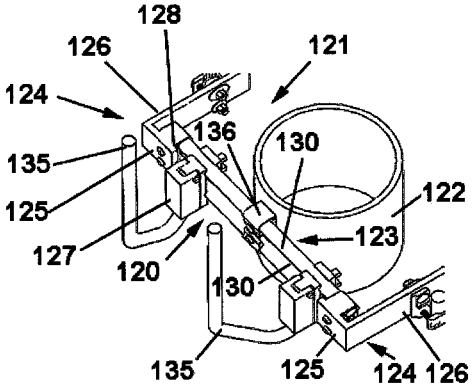
FIG. 17 is an isometric view of an embodiment of supporting hardware supporting an array of drums, as in a marching drum assembly, having hinged sliders for the supporting J-rods of the hardware.
Figure 18:
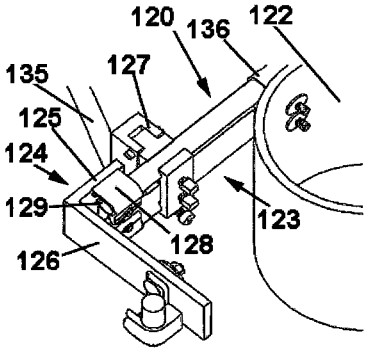
FIG. 18 is a detail isometric view of part of the embodiment shown in FIG. 17.
Figure 19:
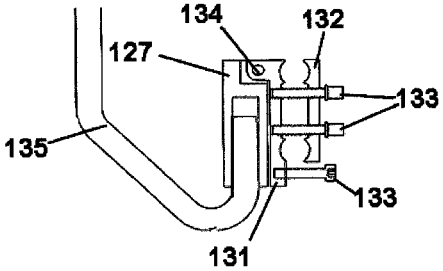
FIG. 19 is a detail view in side elevation of the pivoted hinge in the embodiment shown in FIG. 17.
Figure 20:
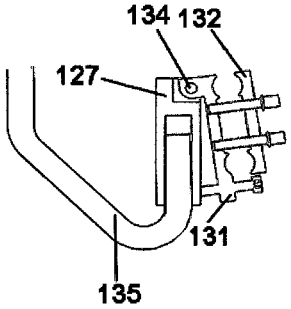
FIG. 20 is a detail view in side elevation of the pivoted hinge in the embodiment shown in FIG. 17 with the hinge in a tilted position.
Figure 21:
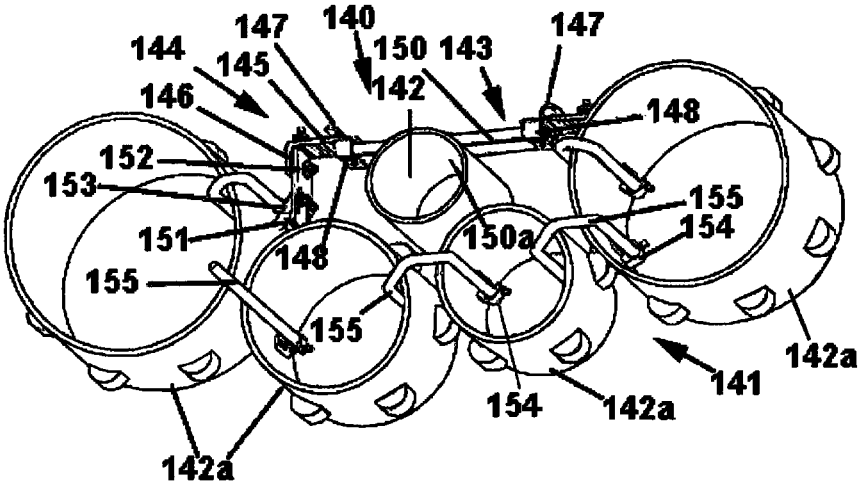
FIG. 21 is an isometric view of another embodiment of supporting hardware supporting an array of drums, as in a marching drum assembly, as in FIG. 3 and FIG. 4, but having a tubular swivel support for the drums fitting existing lugholes in the drums.
Figure 22:
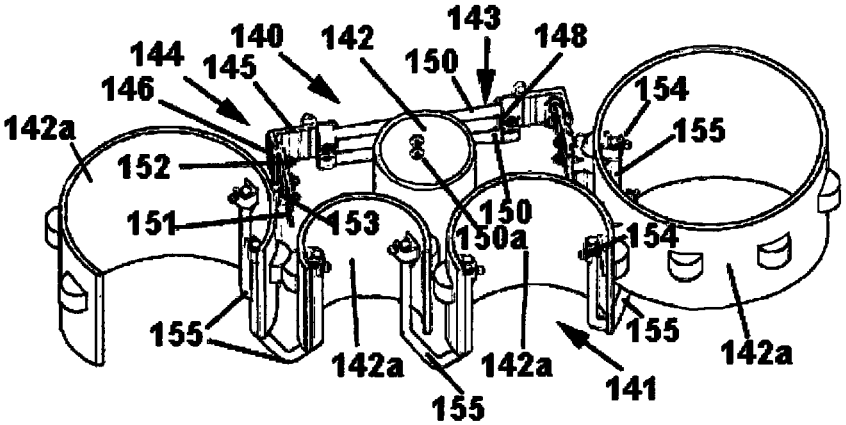
FIG. 22 is a cut away view of the embodiment shown in FIG. 21.

FIGS. 15 and 16 illustrate the operation of this hinge assembly to tilt drum 82 while keeping the drum in a fixed vertical position. Supporting plate 109 is maintained in a vertical position against rods 90 while clamping plates 117 on the upper and lower rods 104 are adjusted to tilt the drum head backward, as in FIG. 15, or to tilt the drum head forward, as in FIG. 16.

A Further Embodiment for Supporting Drum Arrays

Refer now to FIGS. 17-20 that show a hinge assembly 120 for supporting a multiple drum assembly or array 121 as used in marching bands. Hinge assembly 120 is similar in function to those shown in FIGS. 13-17 of May U.S. Pat. No. 6,028,257 with additional features permitting adjustability that is not possible in the embodiment of the patent.

Multiple drum assembly or array 121 (FIGS. 17, 18) comprises at least one drum 122 secured for support and carrying by a drummer as in a marching band. Drum array 121 includes drum 122 supported on the fixed part of a hinge assembly. In this embodiment, hinge assembly 120 provides a hinged support between the drum array 121 and a suitable marching carrier 16 or 26 as shown in FIGS. 1 and 2.

Hinge assembly 120 (FIGS. 17, 18) comprises a back bar assembly that is the fixed member of the hinge. Back bar assembly 123 has two end pieces 124 each of which comprises a one-piece casting having a flat portion 125 with a bent portion 126 bent at a right angle thereto.

Flat portion 125 has J-rod receptacles 127 formed integral therewith, in which J-rods are supported. A socket member 128 is secured on each flat portion 125. Socket member 128 has two cylindrical rods 130 that fit on opposite ends into receptacles 129. Clamp member 136 supports drum 122 on rods 130. J-rod receptacles 127 are clamped on rods 130 by a split clamp having a base portion 131 (FIGS. 19 and 20) and clamping portion 132 secured thereon by bolts 133. Base portion 131 is hinged to receptacle 127 at 134. The upper two bolts 133 extend through base portion 131 and clamping portion 132 and, when tightened, clamp the receptacle 127 on rods 130. The lowermost bolt 133 extends through base member 131 to engage receptacle member 127 and, when tightened, tilts the clamping members 131, 132 as in FIGS. 19 and 20.

Operation

Hinge assembly 120 is supported by positioning J-rod receptacles 127 over J-rods 135 on a marching vest or on a fixed drum support. Drum 122 is supported on rods 130 and is movable thereon. Drum 122 is supported on rods 90 for sidewise adjustment, and permits adjustment of the spacing if more than one drum 82 is positioned thereon. Rods 130 can be tilted in relation to J-rod receptacles 127 by operation of the lowermost bolt 133 as described above.

A Further Embodiment for Supporting Drum Arrays

A hinge assembly 140 (FIGS. 21 and 22) is provided for supporting a multiple drum assembly or array 141 as used in marching bands. Hinge assembly 140 is similar in function to that shown in FIGS. 13-17 of May U.S. Pat. No. 6,028,257 with additional features permitting adjustability that is not possible in the embodiment of the patent. Multiple drum assembly or array 141 (FIGS. 21 and 22) comprises a plurality of drums 142 and **142*a* secured for support and carrying by a drummer as in a marching band. Drum array 141 includes drum 142 supported on the fixed part of a hinge assembly and drums 142*a* (shown in broken section) supported on the movable part of the hinge assembly 140. In this embodiment, hinge assembly 140 provides a hinged support between the drum array 141 and a suitable marching carrier 16 or 26 as shown in FIGS. 1 and 2. Hinge assembly 140 (FIGS. 21 and 22) comprises a back bar assembly 143 that is the fixed member of the hinge. Back bar assembly 143 has two end pieces 144 each of which comprises a one-piece casting having a flat portion 145 with a bent portion 146 bent at a right angle thereto. Flat portion 145 has J-rod receptacles 147 formed integral therewith, in which J-rods are supported. A socket member 148 is secured on each flat portion 145. Socket member 148 has two cylindrical rods 150 that fit on opposite ends into receptacles therein. Drum 142 is supported on rods 150 by a clamp member (not shown). Bent portions 146 have plates 151 pivotally supported thereon by hinge bolts 152. J-rod receptors 153 on hinge plates 151 to support drums 142*a*. Each of drums 142*a* has at least two J-rod receptors 154 for supporting and interconnecting the drums by U-shaped rods 155 as seen in the bottom view FIG. 21 and top view FIG. 22. Receptors 154 each have clamping screws or bolts for securing the U-shaped rods 155 therein. Another attribute of the U-shaped rods or tubes 155** is that the rods extend below the bottom surface of the drums. When the drums are removed from the carrier, the drums can be placed onto the U-shaped rods or tubes and suspended from the ground. This allows the drums to be placed on grass or other moist surfaces without moisture making contact with the rim of the drum and possibly causing damage to the drum. The tubes or rods may be coated with a cushion or pad located on the bottom ends of the tubes or rods.

Operation

Hinge assembly 140 is supported by positioning J-rod receptacles 147 over J-rods on a marching vest or on a fixed drum support. Drum 142 is clamped on rods 150, by bolts 150*a*, and is movable thereon for sidewise adjustment, and permits adjustment of the spacing if more than one drum 142 is positioned thereon. Drums 142*a* are interconnected and supported on hinge plate members 151. This arrangement permits the drums 142*a* to be pivoted relative to the drum carrier and relative to the drum 142 on supporting rods 150.

Figure 23:
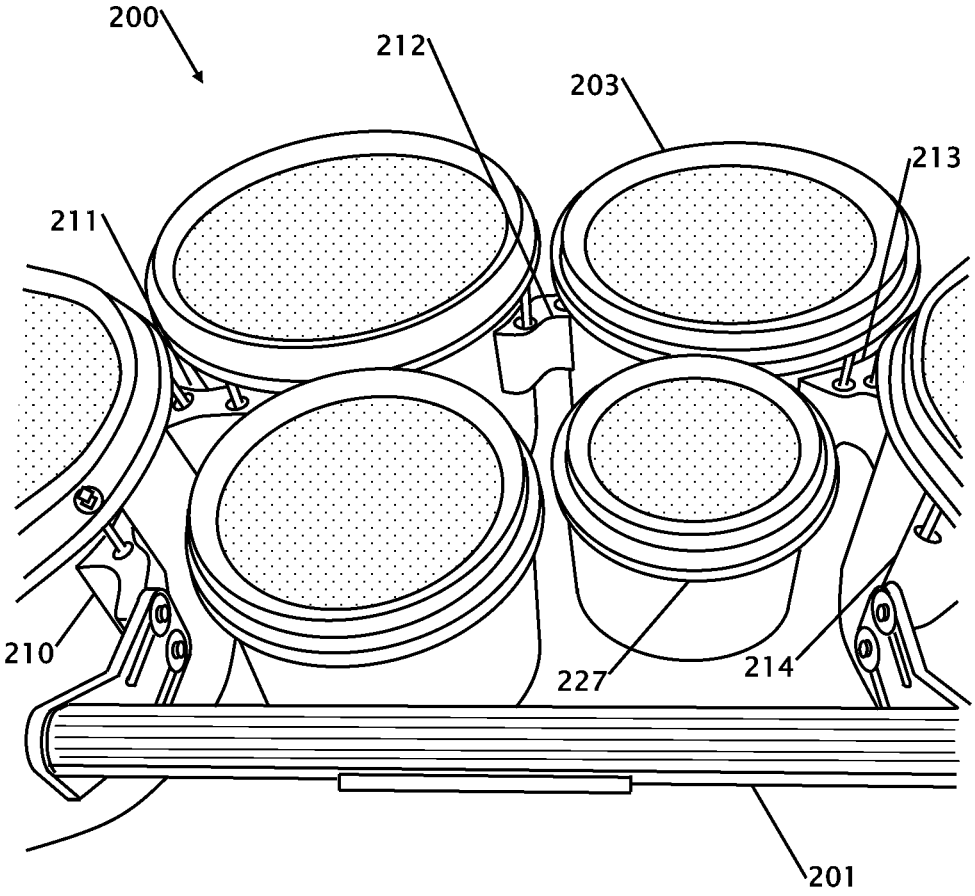
FIG. 23 shows an array of drums connected with the lug bridge.

FIG. 23 shows an array of drums 200 connected with a plurality of lug bridges. The drum array 200 is shown with a plurality of drums 203 mounted on a tenor back bar 201. A plurality of lug bridge attachement hardware 211, 212 and 213 connects the drums together. Lug bridge connectors 210 and 214 connects from the drum array to the tenor back bar or drum supporting hardware 201. The individual drum lug bridge interconnecting members are shown in FIG. 24.

Figure 24:
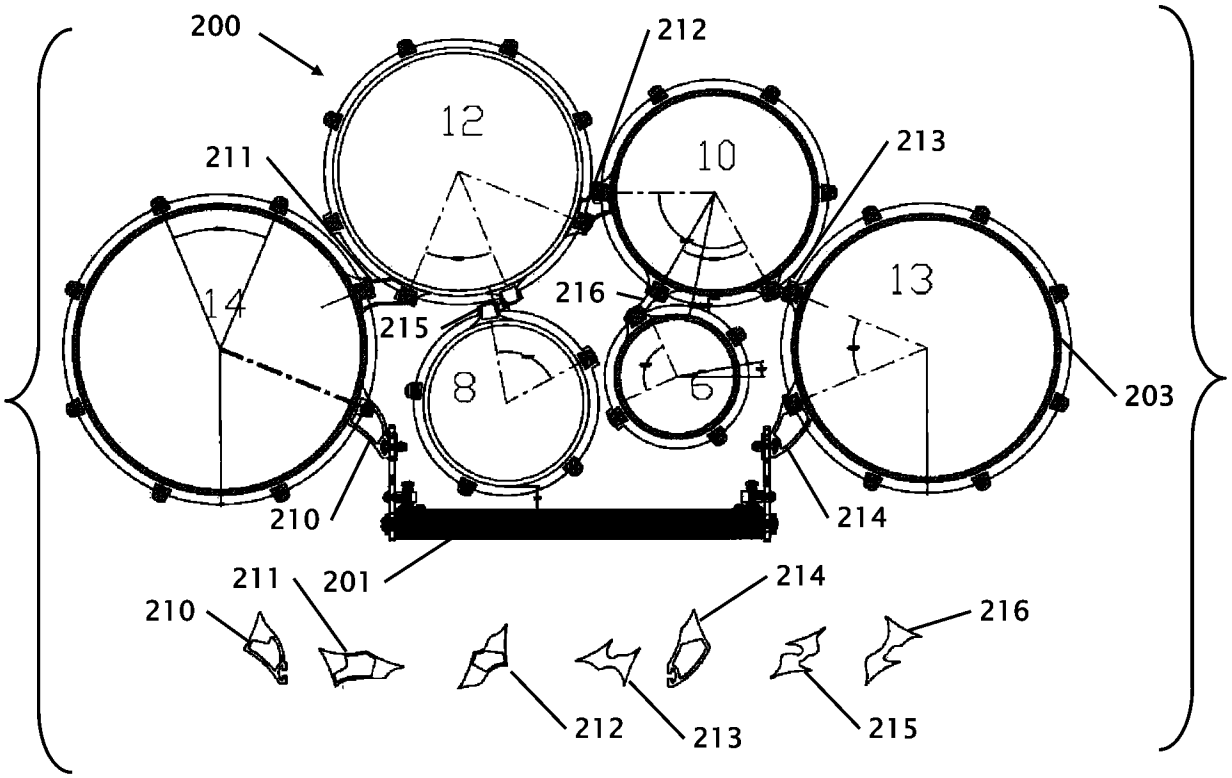
FIG. 24 shows a top view of the drum array with separate profiles of each of the lug bridges.

FIG. 24 shows a top view of the drum array 200 with separate profiles of the different lug bridge connection members 210-216 of each of the lug bridges. Profile 210 connects between the carrier frame and a 14 inch drum. Profile 211 connects between a 14 inch drum and a 12 inch drum. Profile 212 connects between a 12 inch drum and a 10 inch drum. Profile 213 connects between a 10 inch drum and a 13 inch drum. Profile 214 connects between the drum supporting hardware and a 13 inch drum. Profile 215 connects between a 8 inch drum and a 12 inch drum. Profile 216 connects between a 6 inch drum and a 10 inch drum.

Figure 26:
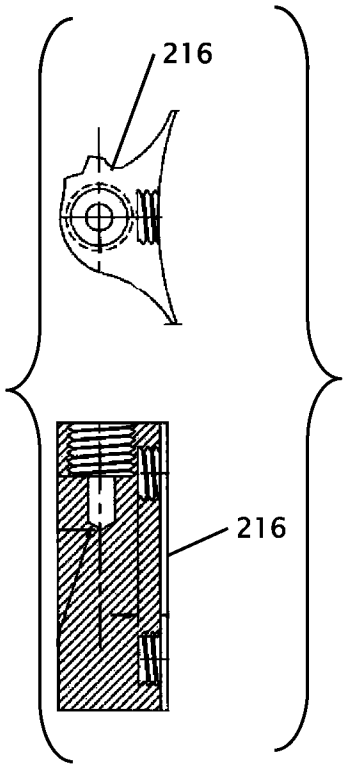
FIG. 26 is another fabrication drawing of lug from FIG. 25.
Figure 25:
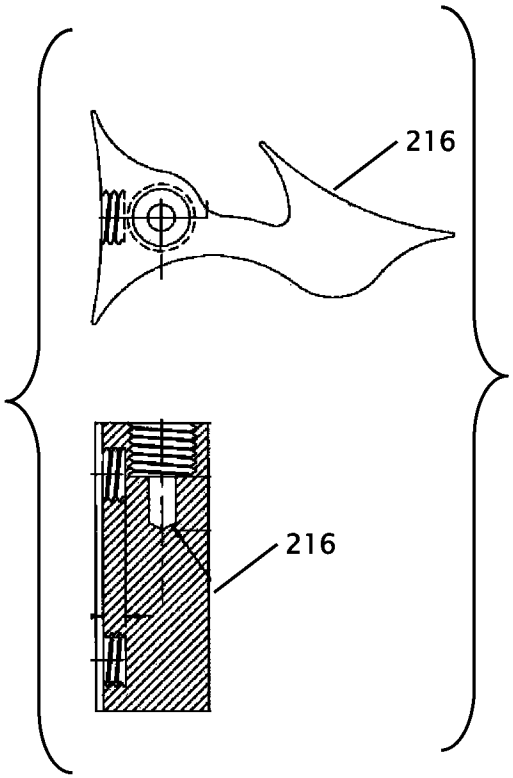
FIG. 25 is a fabrication drawing of a lug.

FIG. 25 is a fabrication drawing of a lug bridge and FIG. 26 is another fabrication drawing of a lug bridger from FIG. 25. All of these drawings show one of the lug bridge connectors 216 with various fabrication details. Each of the lug bridge connectors 210-216, from FIG. 24, has a unique profile and fabrication. While seven different profiles are shown it is contemplated that more than seven can be used as well as less than seven, or a single lug bridge connector can be used in more than one location. Each lug bridge connector has threaded features, hardware or inserts that provide structural support to connect to the lugs of the assiciated drum(s).

Figure 27:
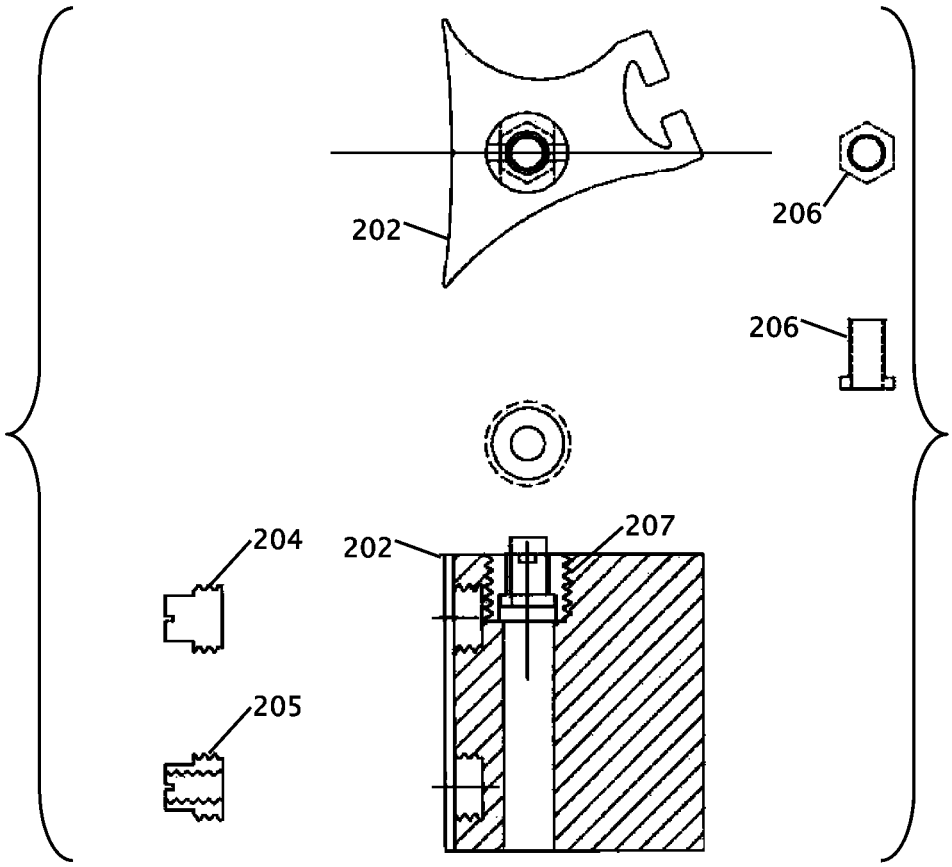
FIG. 27 shows an assembly drawing of a lug with threaded mounting inserts.

FIG. 27 shows an assembly drawing of a lug bridge 202 with threaded mounting inserts 204 and 205. This lug bridge 202 creates a connection from a single drum to the tenor back bar or drum supporting hardware as shown in FIGS. 23 and 24. The standard lug barrel 206 is shown that can be reused from a pre-existing drum lug casing. A relief 207 exists for accepting another insert.

Figure 28:
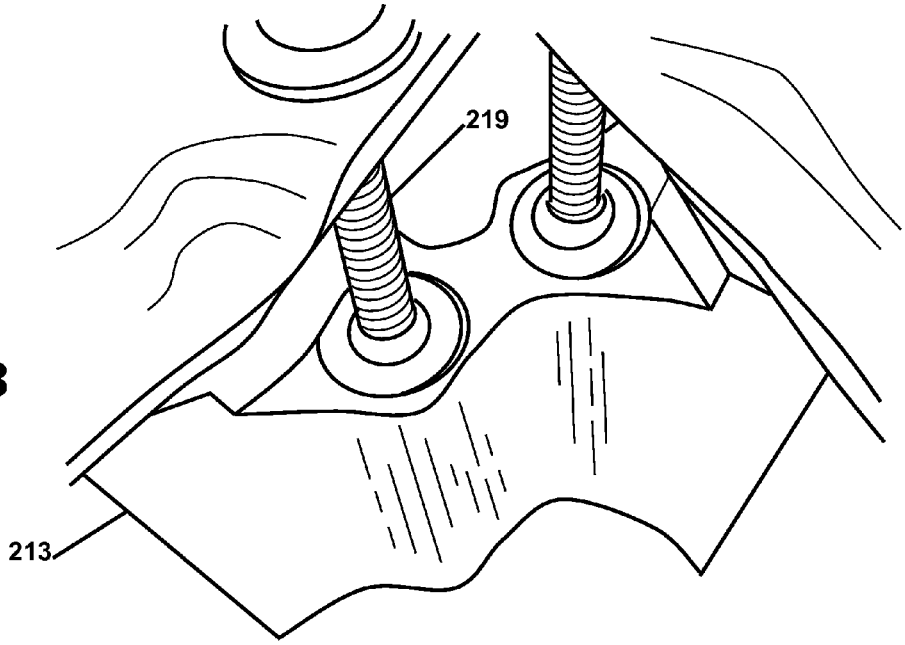
FIG. 28 shows a persepective view of a solid lug.
Figure 29:
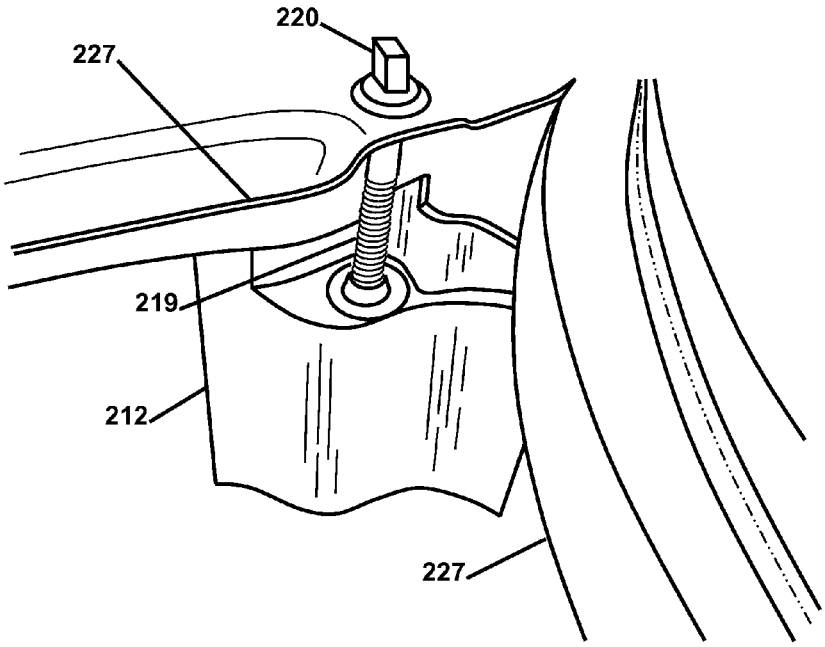
FIG. 29 shows a persepective view of a hollow lug.

FIG. 28 shows a persepective view of a solid lug bridge 213 and FIG. 29 shows a persepective view of a hollow lug bridge 212. These perspective views show the lug(s) bridge(s) connected to the tension rod 219 of the drum, and the tension rod adjustment head 220 that is connected through the couterhoop 227 of the drums existing hardware.

Figure 30:
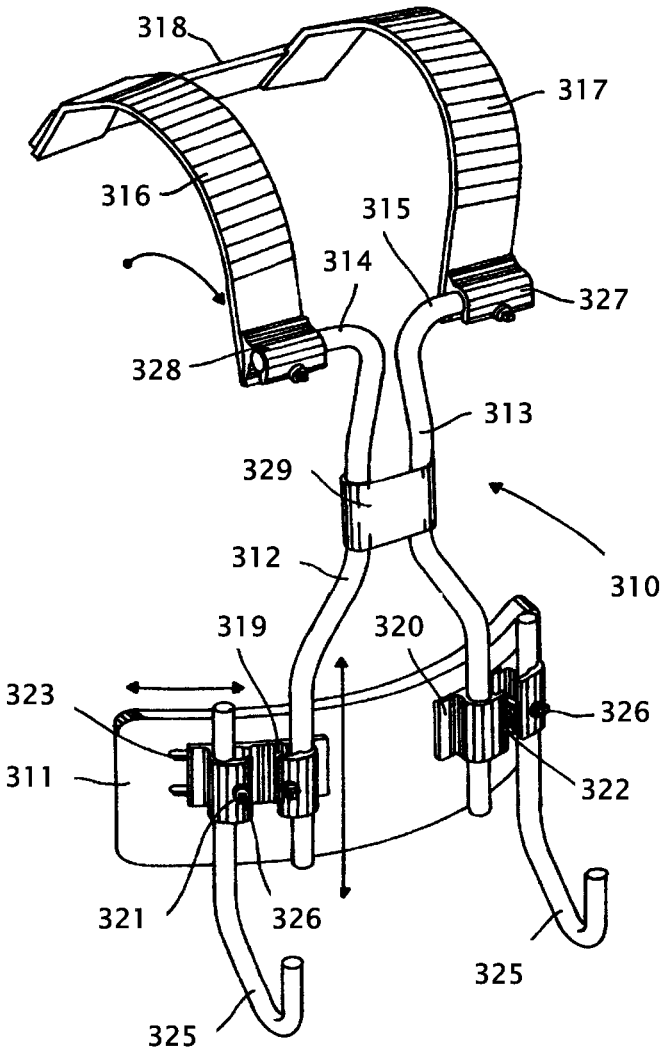
FIG. 30 is a front isometric view of hardware for supporting a drum in accordance with a preferred embodiment of the invention.

Referring to FIG. 30 there is shown a tubular or T-bar-type carrier 310 for percussion instruments which comprises a belly plate 311, vertical supporting rods, tubes or pipes 312 and 313 having outturned portions 314 and 315 supporting rigid shoulder supports 316 and 317 and back bar 318. Back bar 318 may be removably secured to shoulder supports 318 or may be fixed as by welding or the like.

Belly plate 311 is removably secured on the lower ends of vertical rods, tubes or pipes 312 and 313 by clamping receptacles 319 and 320. J-rod receptacles 321 and 322 are secured on belly plate 311 in slots 323 and 324 by screws or bolts or the like. J-rods 325 are secured in receptacles 321 and 322 by bolts 326. The upper, out-turned ends 314 and 315 of supporting rods, tubes or pipes 312 and 313 are supported in clamping receptacles 327 and 328 on shoulder supports 316 and 317. A clamp 329 holds rods, tubes or pipes 312 and 313 against lateral and or torque displacement.

The materials of construction used in this carrier 310 are very important for achieving the desired result. The belly plate 311, vertical supporting rods, tubes or pipes 312 and 313, shoulder supports 316 and 317 and back bar 318 are rigid and made of a light material such as plastic or a light metal such as aluminum, magnesium or titanium. The metal shoulder supports have the advantage that different sizes are readily accommodated.

Operation

The operation of this carrier should be apparent but will be described briefly for clarity. The carrier 310 is worn by the musician with the shoulder supports 316 and 317 positioned over the shoulders and the belly plate 311 supported against the abdomen. J-rods 325 are inserted in position and secured in place by tightening bolts 326. The short outer ends of the J-rods 325 are inserted into the J-rod receptacles on the percussion instrument being carried, e.g., drums (single or array), cymbals, xylophone, marimba, or the like.

The carrier is adjustable to comfort of the wearer and also to fit different sized instruments. Clamp-receptacles 327 and 328 permit pivotal, lateral and angular adjustment of shoulder supports 316 and 317 on the out-turned ends 314 and 315 of rods, tubes or pipes 312 and 313. Clamp-receptacles 319 and 320 permit vertical sliding adjustment of rods, tubes or pipes 312 and 313. Slots 323 and 324 in belly plate 311 allow lateral adjustment of clamp-receptacles 321 and 322 and angular adjustment of J-rods supported therein.

Figure 31:
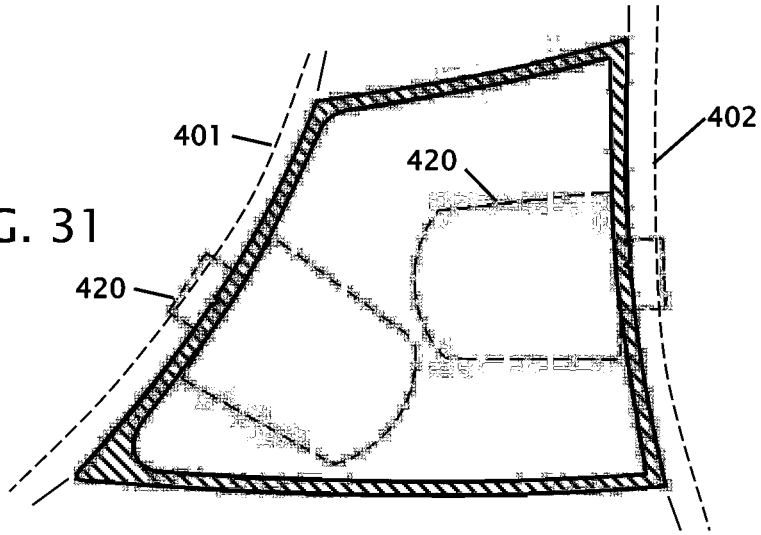
FIG. 31 is a plan view of a one-piece connecting lug bridge member between drums.

FIG. 31 is a plan view of a one-piece connecting lug bridge member between a 10 inch drum 401 and a 13 inch drum 402. While radii for a 10 inch and a 13 inch drums are shown and described various larger or smaller radii of the parts are contemplated to accommodate different sized drum shell diameters. The drum lugs or tension lug casings 420 pass through holes in the sides of the one-piece connecting member to secure the 10 and 13 inch drums. This member is essentially formed as a hollow extrusion or as a casting where holes or slots are drilled through the walls to accept the lug 420 centerline holes.

Figure 32:
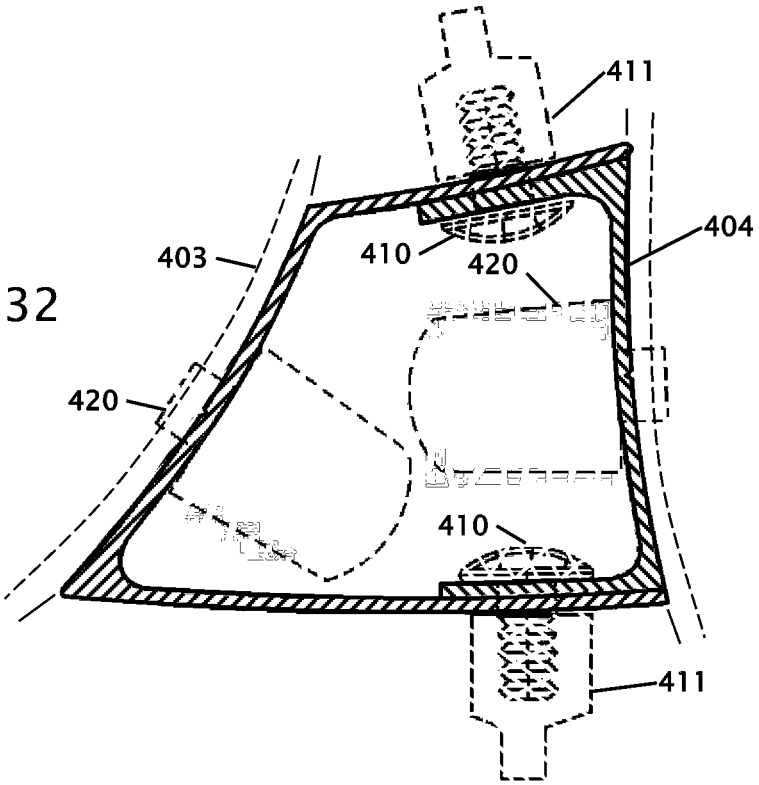
FIG. 32 is a plan view of a two-piece expandable drum connecting member.

FIG. 32 is a plan view of a two-piece expandable lug bridge connecting member between a 10 inch drum 403 and a 13 inch drum 404. The lugs 420 pass through holes in the sides of the one-piece connecting member to secure the 10 and 13 inch drums.

In addition to holes that are used to secure the lugs 420 this version of the connecting member have holes for fasteners 410 to pass through the two-piece connector and into nuts 411 or other equivalent receivers. It is contemplated that either the 10 inch drum joining member 404 and or the 13 inch drum joining member 403 can be exchanged or replaced with members that accept different sized drums. The drum connecting member connects to and or with the lug 420 by using the pre-existing holes in the drum and does not require new or additional holes to be drilled into or through the drum shell.

Figure 33:
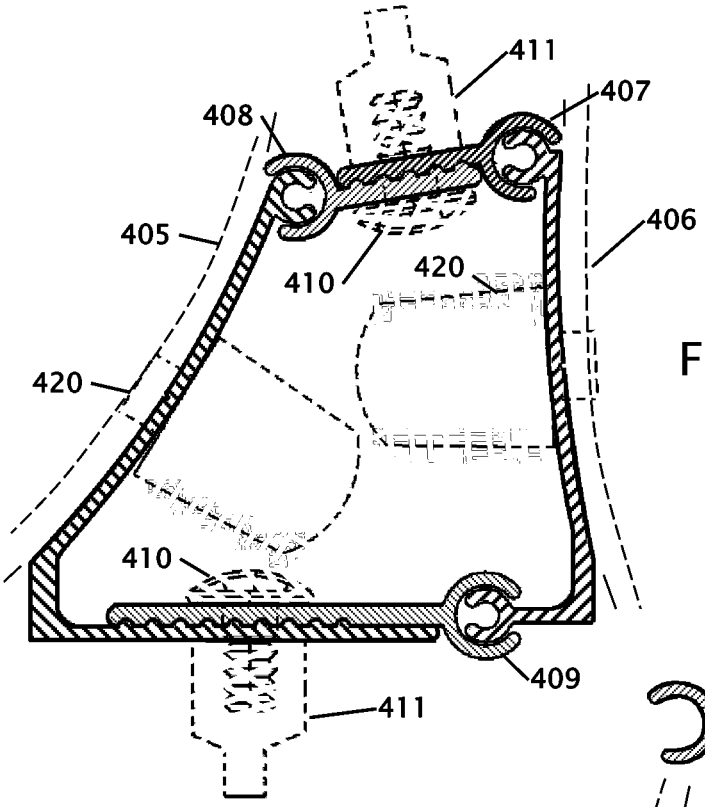
FIG. 33 is a plan view of an assembled adjustable drum lug bridge connecting member.
Figure 34:
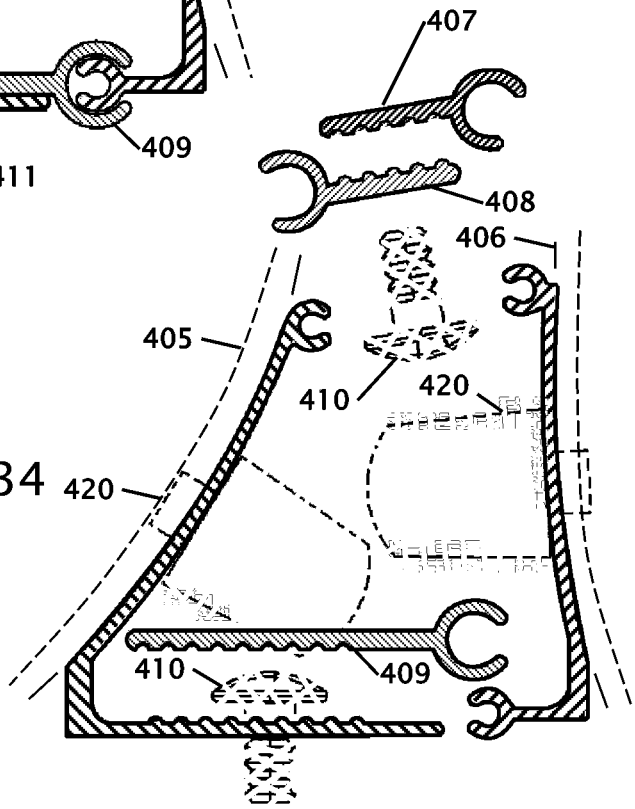
FIG. 34 is a plan view of the drum lug bridge connecting member of FIG. 33.

FIG. 33 is a plan view of an assembled adjustable drum lug bridge connecting member and FIG. 34 is a plan view of the drum lug bridge connecting member of FIG. 33 for connection between a 10 inch drum 405 and a 13 inch drum 406. This configuration of a connecting member accommodates angular changes and the 10 inch drum side 405 is moved relative to the 13 inch drum side 406 both in an angular relationship and or in a linear relationship as desired by the performer. Nesting arms 408 and 407 can pivot in the 10 inch drum side 405 and the 13 inch drum side 406 respectively. A series of surface topography such as but not limited to detents in arm 408 nest into recesses in arm 407. The detents and recesses are secured into location with hardware 410 and 411. In addition to the arms 407 and 408 a separate set of detents and recesses exist on arm 409 and the 10 inch drum connection member 405. This configuration allows items 405 and 406 to be independently adjusted and secured to accommodate spacing of the drum lugs 420. While radii for a 10 inch and a 13 inch drums are shown and described various larger or smaller radii of the parts are contemplated to accommodate different sized drum shell radii by substituting the drum connecting member. It is further contemplated that a lug bridge connecting member can accommodate a drum with radii that is slightly larger or smaller than the intended drum radii by using a spacer, cushion or other device.

Figure 35:
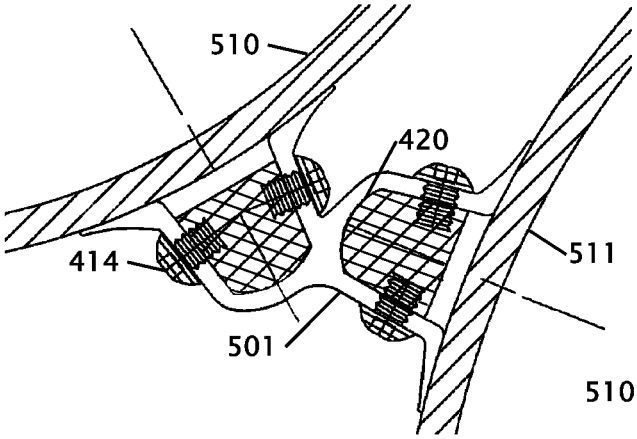
FIG. 35 is an underside plan view of a one-piece drum connecting member that is secured to drum lugs.
Figure 36:
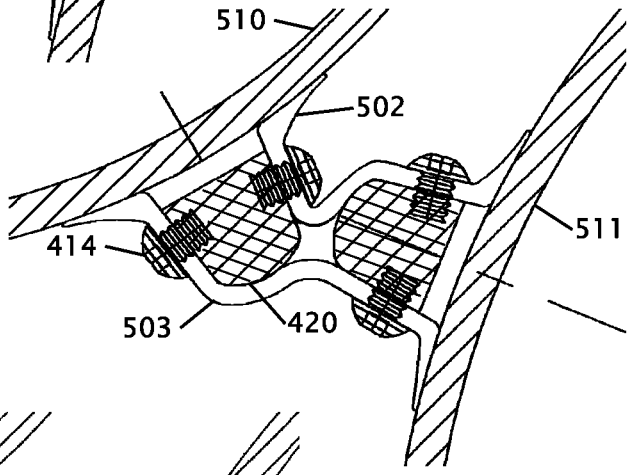
FIG. 36 is an underside plan view of a two-piece drum connecting member that is secured to drum lugs.
Figure 37:
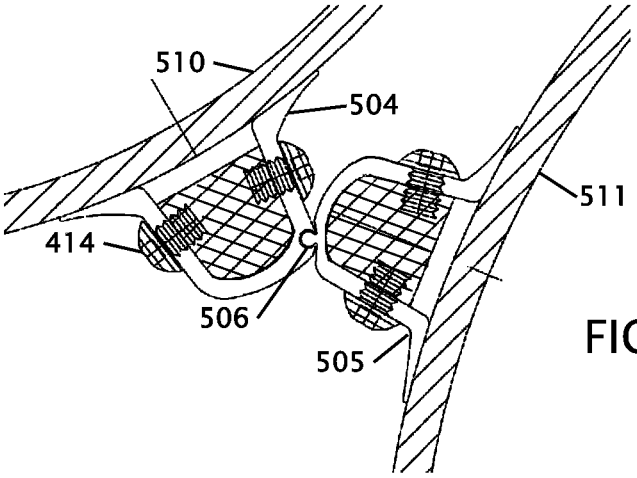
FIG. 37 is an underside plan view of a pivotable drum connecting member that is secured to drum lugs.

FIG. 35 is an underside plan view of a one-piece lug bridge connecting member 501 that is secured to drum lugs 420, FIG. 36 is an underside plan view of a two-piece drum connecting member that is secured to drum lugs 420 and FIG. 37 is an underside plan view of a pivotable drum connecting member that is secured to drum lugs 420. Each of these three configurations are secured to the lugs 420 that exist on drums 510 and 511. In most cases the position and angualar relationship between the drums 510 and 511 are constant. In the configuration where distance and angualar relationship between the drums 510 and 511 are constant the connector(s) in FIGS. 35 and 36 provide sufficient rigid connection between the drums 510 and 511.

When the angualar relationship between the drums can change, as when using the connector from FIGS. 33 and 34 a pivoting connector, as shown in FIG. 37 accomodates the angualar changes with a rod and socket hinge arangement 506.

Figure 38:
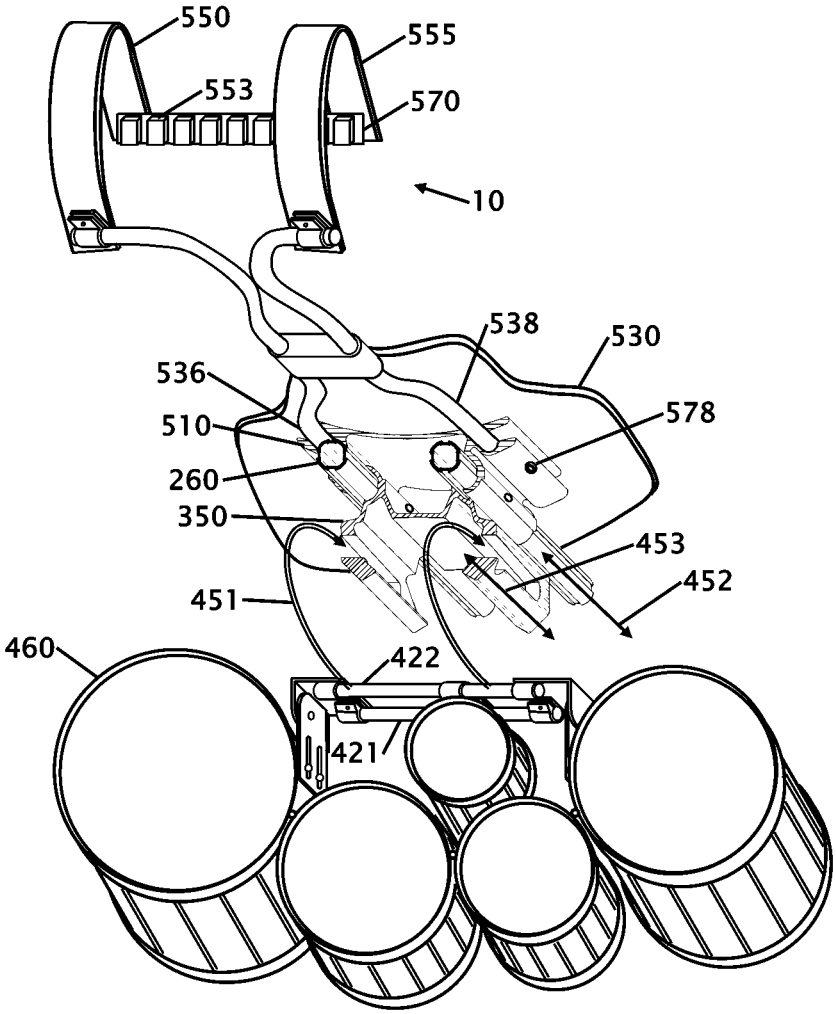
FIG. 38 is a second preferred embodiment showing the dual track system secured to an instrument carrier with a drum assembly that is mountable on the dual track system.

FIG. 38 shows the parallel track system secured to an instrument carrier with a drum assembly that is mountable on the parallel track system. The shoulder supports and or back member may optionally include padding 553. The tubular carrier shown includes an abdomen plate 530 that is secured or can float on the structure without being rigidly secured to first bifurcated structure 510. In the embodiment shown the first bifurcated structure 510 is shown and described as a single structure but it is contemplated that the structure could be fabricated in two halves where each half is secured to the abdomen plate to form the structure. Tubes 536 and 538 of the carrier bend and extend into first bifurcated structure 510 where they are positionable and lockable in position using tightening hardware 578. The tubes 260 slide in first bifurcated structure 510 and in second bifurcated structure 350 to allow for positioning of the drum array and drum hardware 460. In the embodiment shown the second bifurcated structure 350 is shown and described as a single structure but it is contemplated that the structure could be fabricated in two halves where each half is secured to the tubes or shafts 260. The tubes or shafts 260 can be movable 452, as well as the second bifurcated structure 350 are movable 453 independently.

Figure 39:
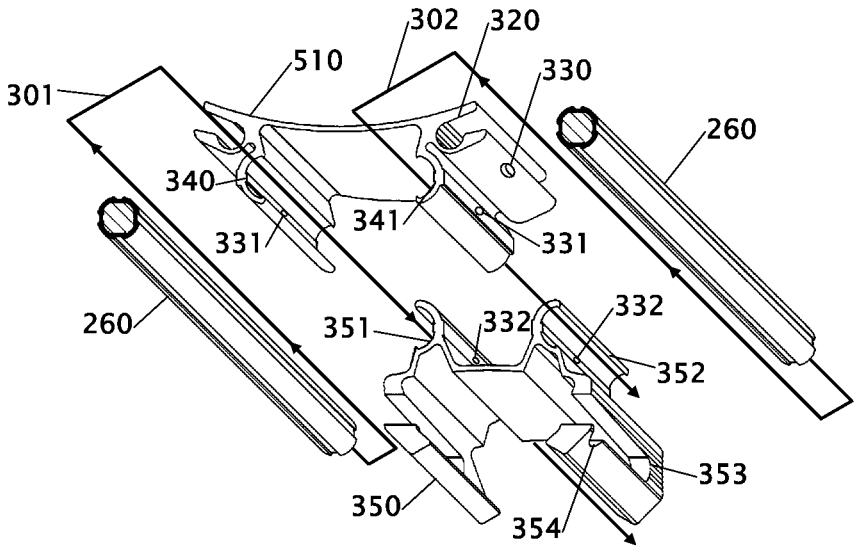
FIG. 39 shows the components of a second preferred embodiment of a dual track system that is mounted to an instrument carrier from FIG. 38.

In operation the upper tube 422, from the drum array, is lowered 451 into the essentially vertical slot until the bottom tube 421 from the drum array rests on the bottom radius or saddle (353 from FIG. 39). The cantilevered weight of the drum array will rotate the drum array until the upper tube 422 of the drum supporting array sits in the top radius (354 from FIG. 9). It is contemplated that the shafts or tubes 260 are fabricatable as an integral part of either first bifurcated structure 510 or the second bifurcated structure 350 to allow for only one adjustment.

FIG. 39 shows the components of a dual track system that is mounted to an instrument carrier. For a better understanding of the components and how they relate, FIG. 39 should be viewed in combination with FIG. 38. In FIG. 39 the first bifurcated structure 510 is shown. This first bifurcated structure 510 has a radiused back that matches the contour of the abdomen plate that the structure in mounted on. On the front of the first bifurcated structure 510 linear tracks 340 and 341 and the tubes 260 are securable with sets screw 331. The parallel linear tracks provide a first dual track structure. The tracks are located essentially parallel to the abdomen plate and at a location that is distal from the abdomen plate in a vertical orientation. It is contemplated that the abdomen plate 530 can float on the structure without being rigidly secured to first bifurcated structure 510. The first bifurcated structure 510 further includes mounting clamps 320 for securing tubular shafts for connection with the shoulder supporting portion of a carrier. The connection with the tubular portion of the shoulder supported portion of the carrier. A locking mechanism is threaded or fastened into the carrier at 330 to pinch or thread into the tube(s) 536 or 538 (FIG. 38).

In FIG. 39 tubes 260 are slid 301 and 302 into the linear tracks 340 and 341 respectively. The linear tracks 340 and 341 have male dovetail recesses that engage in female dovetail recesses in tubes or rods 260. The tube and linear track is essentially the same configuration as shown and described in FIG. 40 herein. The tubes or shafts 260 are locked in location on the linear tracks of the first bifurcated structure 510 with a securing means such as a set screw. The second bifurcated structure 350 engages on the tubes 260 between the first bifurcated structure 510 to allow independent movement of the second bifurcated structure 350. The second bifurcated structure 350 has similar recess 351, 352 and dovetail engagement with the tubes or shafts 260 as in the first bifurcated structure 350. The second bifurcated structure 350 is secured to the tubes or rods 260 with securing means such as a set screw 332. In the front of the second bifurcated structure a pair of essentially vertically oriented slots exists for loading at least one drum or an array of drums. The vertical slots have a bottom radius or saddle 353 and a top radius 354 for locating the drum or drum array in the essentially vertically oriented slots. A further description of the vertical slots for securing one or more drums is shown and described in more detail with FIG. 38.

Figure 40:
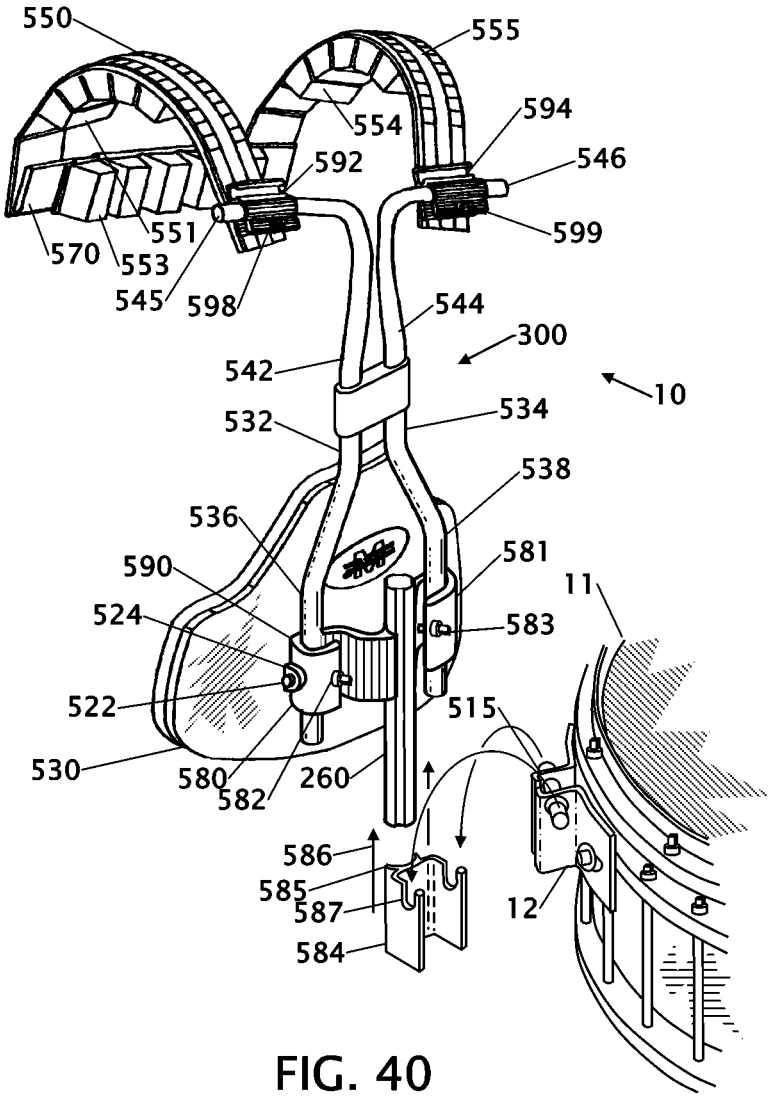
FIG. 40 shows a view of the drum tracking system for use with a single drum.

FIG. 40 shows a view of the drum tracking system for use with a single drum 11. The carrier 10 comprises an abdomen plate 530, with lower support rods 532 and 534. The figure also has upper body vertical support rods or tubes 542 and 544. The upper and lower body support rods or tubes are connected to each other with a retainer 300 that keeps the tubes in a parallel relationship. The lower rods or tubes 532 and 534 independently spread to parallel portions 536 and 538 where they attach to supporting abdomen plate 30. Upper rods or tubes 542 and 544 having out-turned portions 545 and 546 supporting rigid shoulder straps 550 and 555 and back bar 570. Back bar 570 may be removably secured to shoulder straps 550 and 555 or may be fixed as by welding or the like. Shoulder straps 550, 555, and back bar 570 have cushions 551, 553 and 554, respectively. The cushions are of a type used to pad the interior of football and other sports helmets and enclose separate blocks which are separately compressible and provide more comfort to the wearer of the carrier when fully loaded.

The abdomen plate 530 is secured to the bridge supports 590 with a pivot 522 that extends through ears 524 on the abdomen plate 530. The placement of the pivot through the center of the bridge support 590 allows the abdomen plate to rotate a limited amount on the pivot(s) 522. The pivoting allows the abdomen plate to move with the user without significantly altering the position of the carrier on the user.

The pivots can be tightened slightly to provide frictional or limited pivoting as well as loosened to allow for free pivoting. It is also contemplated that the abdomen plate 530 is removably secured on carrier.

Clamping receptacle(s) 580 and 581 consist of a semi-circular receptacle that tubes 536 and 538 fit through. Tightening hardware 582 and 583 clamps the tube or rod to secure them within the receptacle and prevent movement. The clamping receptacle(s) 580 and 581 are secured on abdomen plate 530. The receptacles are shown mounted to the abdomen plate 530, and the tubes can be re-positioned within the receptacle, but the receptacles can be mounted to slots that allow the locations of the receptacles to be moved. The upper, out-turned ends 545 and 546 of supporting rods or tubes are supported in clamping receptacles 592 and 594 on shoulder straps 550 and 555. Clamps 592 and 594 hold rods or tubes 545 and 546 on the shoulder supports. Clamping mechanisms 592 and 594 consist of a semi-circular receptacle that tubes 545 and 546 fit through. Tightening hardware 598 and 599 clamps the tube or rod to secure them within the receptacle and prevent movement. A single tube or shaft 260 is used to connect with a single drum 11 through a sliding cradle 584.

The sliding cradle 584 connects to the single tube or shaft 260 with dovetail grooves. A second set of dovetail grooves exist on the bridge support member 590. The bridge support member 590 has male dovetail grooves that mate with the female dovetail groves in the tube or shaft 260. A similar set of male dovetail features 585 exist on the sliding cradle 584. These dovetail features are arranged to allow the sliding cradle to slide 86 past the bridge support member 590. The sliding cradle 584 has a recessed cradle 587 for connection with the hinge pins 515 of a single drum 11. The hinge pin 515 is secured to the drum 11 with a rotation hinge plate. The rotation hinge plate 12 and its connection to the drum is shown and described in more detail in my prior patent (May U.S. Pat. No. 5,691,492).

Thus, specific embodiments and applications for a carrier assembly for percussion instruments have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A drum lug bridge for use with a plurality of drums, each drum comprising a radial shell and at least one tuning rod and/or drum lug casing, the drum lug bridge comprising:

one or more drum connecting members secured to the at least one drum tuning rod and/or at least one drum lug casing so as to join adjacent drums at their radial shells, the drum connecting members engaging at least one of the following: a hole in the radial shell, the drum tuning rod, and the drum lug casing so as the be fixedly secured thereto, and at least one end drum connecting member connecting to at least one end-drum so as to couple the plurality of drums to an instrument carrier.

2. The drum lug bridge according to claim 1 wherein at least one of said drum lug bridges allows pivotable movement between at least two drums.

3. The drum lug bridge according to claim 1 wherein at least one drum connecting member has radii for a drum between 6 and 14 inches in diameter.

4. The drum lug bridge according to claim 1 at least one terminating drum connecting member has radii for a drum between 6 and 14 inches in diameter.

5. The drum lug bridge according to claim 1 wherein at least one of said drum connecting members is formed from at least two separate parts that at least partially interconnect together.

6. The drum lug bridge according to claim 5 wherein said at least two separate parts have surface topography that interconnect.

7. The drum lug bridge according to claim 1 wherein at least one of said drum connecting members is formed from at least three separate parts that at least partially interconnect together.

8. The drum lug bridge according to claim 1 wherein at least one of said drum connecting members is formed from at least four separate parts that at least partially interconnect together.

9. The drum lug bridge according to claim 6 wherein said surface topography is a plurality of nesting detents and recesses.

10. The drum lug bridge according to claim 1 wherein at least one of said plurality of drum connecting members is at least partially hollow.

11. The drum lug bridge according to claim 10 wherein said at least partially hollow drum connecting member allows for at least one pre-existing drum lug or at least one drum lug casing or at least one drum tension member to fit within said at least partially hollow drum connecting member.

12. The drum lug bridge according to claim 1 wherein at least one of said plurality of drum connecting members is solid.

13. The drum lug bridge according to claim 1 wherein said at least one drum tuning rod and/or said at least one drum lug casing hardware is an factory provided drum tensioning hardware.

14. The drum lug bridge according to claim 1 is formed as a hollow wherein said existing drum tensioning hardware is at least one drum lug or at least one drum casing or at least one drum tension member.

15. The drum lug bridge according to claim 14 wherein said connection to said existing drum tuning rod and/or said at least one drum lug casing hardware is with securing hardware that secures onto or into at least one side of said at least one drum lug or at least one drum casing or at least one drum tension member.

16. The drum lug bridge according to claim 1 wherein said at least one terminating drum connecting member connects with at least two drum tuning rod and/or said at least two drum lug casing hardware members.

17. A drum lug bridge for use with a plurality of drums, each drum comprising a radial shell and at least one tuning rod, the drum lug bridge comprising:

one or more drum connecting members secured to the at least one drum tuning rod so as to join adjacent drums at their radial shells, the drum connecting members engaging at least one of the drum tuning rod so as the be fixedly secured thereto, and at least one end drum connecting member connected to at least one end-drum so as to couple the plurality of drums to an instrument carrier.

18. The drum lug bridge according to claim 17 wherein at least one of said drum connecting members allows pivotable movement between at least two drums.

19. A drum lug bridge for use with a plurality of drums, each drum comprising a radial shell and at least one drum lug casing, the drum lug bridge comprising:

one or more drum connecting members secured to the at least one drum lug casing so as to join adjacent drums at their radial shells, the drum connecting members engaging at least one drum lug casing so as to be fixedly secured thereto, and at least one end drum connecting member connected to at least one end-drum so as to couple the plurality of drums to an instrument carrier.

20. The drum lug bridge according to claim 19 wherein at least one of said drum connecting members allows pivotable movement between at least two drums.

* * * * *